US011559990B2

(12) United States Patent
Yoshita et al.

(10) Patent No.: US 11,559,990 B2
(45) Date of Patent: Jan. 24, 2023

(54) LIQUID DISCHARGE HEAD, DISCHARGE DEVICE, LIQUID DISCHARGE APPARATUS, AND BONDED SUBSTRATE

(71) Applicant: Ricoh Company, Ltd., Tokyo (JP)

(72) Inventors: Akio Yoshita, Kanagawa (JP); Keishi Miwa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 60 days.

(21) Appl. No.: 17/231,213

(22) Filed: Apr. 15, 2021

(65) Prior Publication Data

US 2021/0370675 A1 Dec. 2, 2021

(30) Foreign Application Priority Data

May 27, 2020 (JP) ..... JP2020-091897

(51) Int. Cl.
*B41J 2/14* (2006.01)

(52) U.S. Cl.
CPC .. *B41J 2/14201* (2013.01); *B41J 2002/14491* (2013.01)

(58) Field of Classification Search
CPC ..... B41J 2/14201; B41J 2002/14491; B41J 2002/14241; B41J 2002/14362; B41J 2002/14459; B41J 2202/12; B41J 2/14233
See application file for complete search history.

(56) References Cited

U.S. PATENT DOCUMENTS

| | | | |
|---|---|---|---|
| 2015/0171307 | A1 | 6/2015 | Masuda et al. |
| 2016/0001556 | A1 | 1/2016 | Masuda et al. |
| 2017/0100934 | A1 | 4/2017 | Masuda et al. |
| 2019/0275796 | A1 | 9/2019 | Miwa |
| 2020/0298569 | A1 | 9/2020 | Miwa |
| 2020/0298570 | A1 | 9/2020 | Masuda et al. |
| 2021/0016568 | A1 | 1/2021 | Miwa |
| 2021/0036208 | A1 | 2/2021 | Shimofuku et al. |

FOREIGN PATENT DOCUMENTS

JP 2017-052111 3/2017

OTHER PUBLICATIONS

IP.com search (Year: 2022).*
Machine translation of JP 2017132237 A, Liquid Discharge Head, Liquid Discharge Unit and Device Discharging Liquid, Aug. 3, 2017, Abstract: Solution (Year: 2017).*
U.S. Appl. No. 17/097,629, filed Nov. 13, 2020, Keishi Miwa, et al.

* cited by examiner

*Primary Examiner* — Lisa Solomon
(74) *Attorney, Agent, or Firm* — Xsensus LLP

(57) ABSTRACT

A liquid discharge head is configured to discharge a liquid, and the liquid discharge head includes an actuator substrate and a holding substrate bonded to the actuator substrate. The actuator substrate includes a pressure generator, and a wiring electrode configured to electrically connect the pressure generator and an exterior of the liquid discharge head. The holding substrate includes an opening configured to expose the wiring electrode to the exterior of the liquid discharge head, and a detection surface adjacent to the opening, the detection surface having a higher reflectance than a surface of the wiring electrode of the actuator substrate.

11 Claims, 10 Drawing Sheets

COMPARATIVE EXAMPLE

COMPARATIVE EXAMPLE

LIQUID DISCHARGE HEAD, DISCHARGE DEVICE, LIQUID DISCHARGE APPARATUS, AND BONDED SUBSTRATE

CROSS-REFERENCE TO RELATED APPLICATIONS

This patent application is based on and claims priority pursuant to 35 U.S.C. § 119(a) to Japanese Patent Application No. 2020-091897, filed on May 27, 2020, in the Japan Patent Office, the entire disclosures of which are hereby incorporated by reference herein.

BACKGROUND

Technical Field

Aspects of the present disclosure relate to a liquid discharge head, a discharge device, a liquid discharge apparatus, and a bonded substrate.

RELATED ART

A liquid discharge head includes a bonded substrate in which an actuator substrate and a holding substrate are bonded.

For example, the liquid discharge head includes the bonded substrate in which the actuator substrate including a pressure generator to apply pressure to a pressure chamber and the holding substrate including a concave portion facing the pressure generator of the actuator substrate.

SUMMARY

In an aspect of this disclosure, a liquid discharge head is configured to discharge a liquid. The liquid discharge head includes an actuator substrate and a holding substrate bonded to the actuator substrate. The actuator substrate includes a pressure generator and a wiring electrode configured to electrically connect the pressure generator and an exterior of the liquid discharge head. The holding substrate includes an opening configured to expose the wiring electrode to the exterior of the liquid discharge head, and a detection surface adjacent to the opening, the detection surface having a higher reflectance than a surface of the wiring electrode of the actuator substrate.

In another aspect of this disclosure, a bonded substrate includes a first substrate including a wiring electrode, and a second substrate bonded to the first substrate. The second substrate includes an opening configured to expose the wiring electrode to an exterior of the bonded substrate, and a detection surface adjacent to the opening, the detection surface having a higher reflectance than a surface of the wiring electrode of the first substrate.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
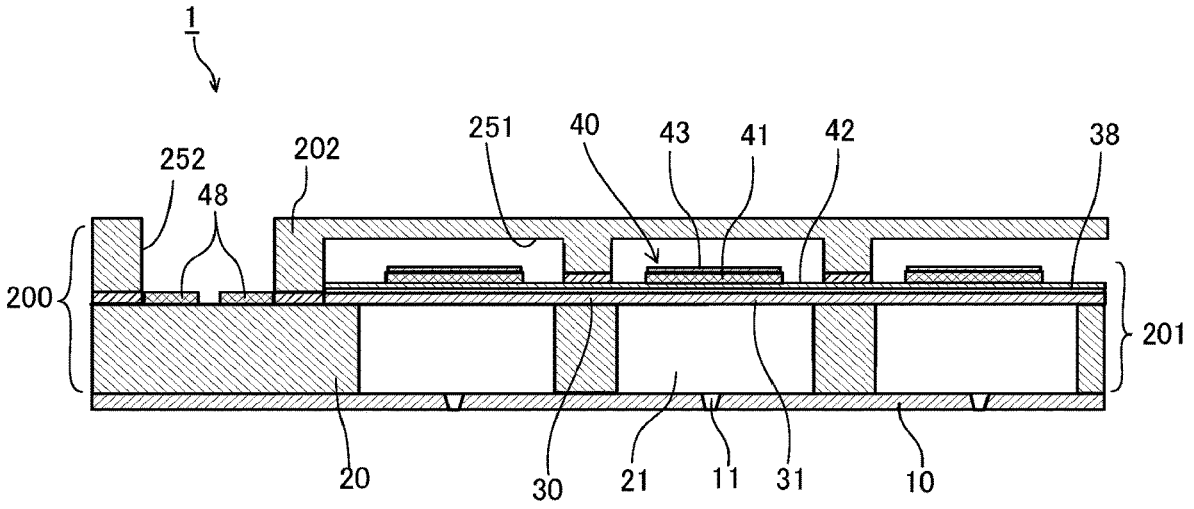
FIG. 1 is a schematic cross-sectional view of a main portion of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Embodiments of the present disclosure are described below with reference to the attached drawings. A liquid discharge head 1 according to a first embodiment of the present disclosure is described with reference to FIGS. 1 to 3. Hereinafter, the "liquid discharge head" is simply referred to as a "head."

FIG. 1 is a schematic cross-sectional view of a main portion of the head 1 according to the first embodiment of the present disclosure.

Figure 2:
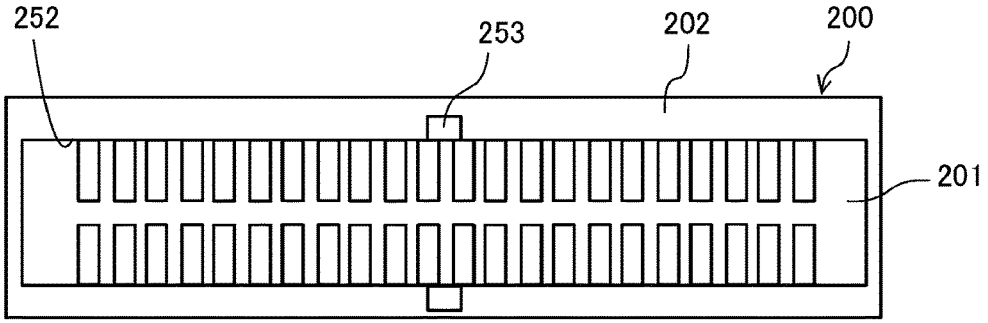
FIG. 2 is a schematic plan view of a bonded substrate of the liquid discharge head according to the first embodiment of the present disclosure.

FIG. 2 is a schematic plan view of a bonded substrate 200 of the head 1 according to the first embodiment of the present disclosure.

Figure 3:
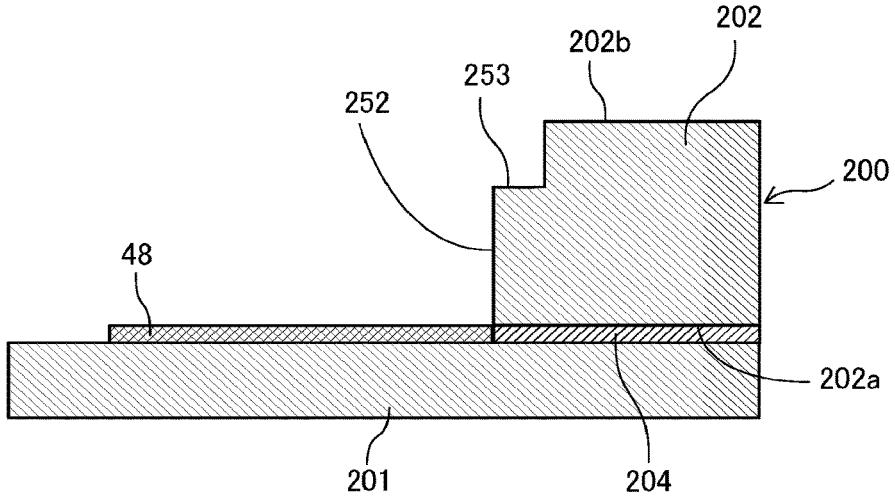
FIG. 3 is a schematic cross-sectional view of the bonded substrate in the vicinity of an opening of the bonded substrate according to the first embodiment of the present disclosure.

FIG. 3 is a schematic cross-sectional view of the bonded substrate 200 in the vicinity of an opening 252 of the bonded substrate 200 according to the first embodiment of the present disclosure.

The head 1 includes a nozzle plate 10 and the bonded substrate 200 according to the first embodiment. The nozzle plate 10 includes nozzles 11 from which a liquid is discharged.

The bonded substrate 200 is a piezoelectric actuator substrate that is a substrate in which a first substrate 201 and a second substrate 202 are bonded with an adhesive 204.

The first substrate 201 is an actuator substrate. The first substrate 201 includes a channel plate 20, a diaphragm 30, and a piezoelectric element 40. Further, the channel plate 20 forms a pressure chamber 21 communicating with the nozzles 11 to discharge a liquid. The diaphragm 30 includes a plurality of displaceable vibration regions 31 that form walls of the pressure chambers 21 in the channel plate 20.

The piezoelectric element 40 includes a piezoelectric body 41, a lower electrode 42, and upper electrode 43. The lower electrode 42 serves as a common electrode. The upper electrodes 43 serve as individual electrodes. The lower electrode 42 and the upper electrode 43 sandwich the piezoelectric body 41. The head 1 includes an adhesion layer 38 between the diaphragm 30 and the lower electrode 42.

The first substrate 201 includes a wiring electrode 48 to connect the upper electrode 43 and the lower electrode 42 of the piezoelectric element 40 and an exterior of the head 1. A metal such as $Al_2O_3$ or the like is used as the wiring electrode 48.

The second substrate 202 is a holding substrate. The second substrate 202 includes an accommodation part 251 and an opening 252. The accommodation part 251 accommodates the piezoelectric element 40 of the first substrate 201. The opening 252 exposes the wiring electrode 48 of the first substrate 201. The opening 252 includes a through hole. The second substrate 202 is formed of a Si substrate. A surface of the second substrate 202 to be bonded to the first substrate 201 is referred to as a "first surface 202*a*", and a surface of the second substrate 202 opposite to the first surface 202*a* is referred to as a "second surface 202*b*" as illustrated in FIG. 3.

The second substrate 202 includes a third surface 253 adjacent to the opening 252 as illustrated in FIGS. 2 and 3. Specifically, the third surface 253 (detection surface) is outside the opening 252 and is adjacent to an inner wall surface of the opening 252 as illustrated in FIGS. 2 and 3. The third surface 253 is also referred to as a "detection surface."

The third surface 253 of the second substrate 202 has a higher reflectance than a surface of the wiring electrode 48 as illustrated in FIGS. 2 and 3. The head 1 according to the first embodiment includes the third surface 253 at a position adjacent to a central portion of the opening 252 in a longitudinal direction of the bonded substrate 200. That is, the third surface 253 is at a position adjacent to a center of the opening 252 in a longitudinal direction of the second substrate 202 (holding substrate).

The third surface 253 is made of the same material as the second substrate 202. The third surface 253 is made of silicon since the second substrate 202 is made of silicon in the first embodiment. The third surface 253 may not be made of silicon as same material as the second substrate 202. The third surface 253 may be made of Si or $SiO_2$, for example. The above-described materials of the third surface 253 have a reflectance higher than a reflectance of the surface of the wiring electrode 48. Further, the third surface 253 is adjacent to an inner wall surface of the opening 252 of the second substrate 202 (see FIGS. 2 and 3).

The third surface 253 is disposed higher than the wiring electrode 48 and lower than the second surface 202*b* of the second substrate 202 when the first surface 202*a* is used as a reference surface. The first surface 202*a* of the second substrate 202 is a bonding surface to be bonded with the first substrate 201.

Next, a film formation of a protective film 301 such as a liquid resistant film on the bonded substrate 200 is be described below with reference to FIGS. 4 and 5.

Figure 4:
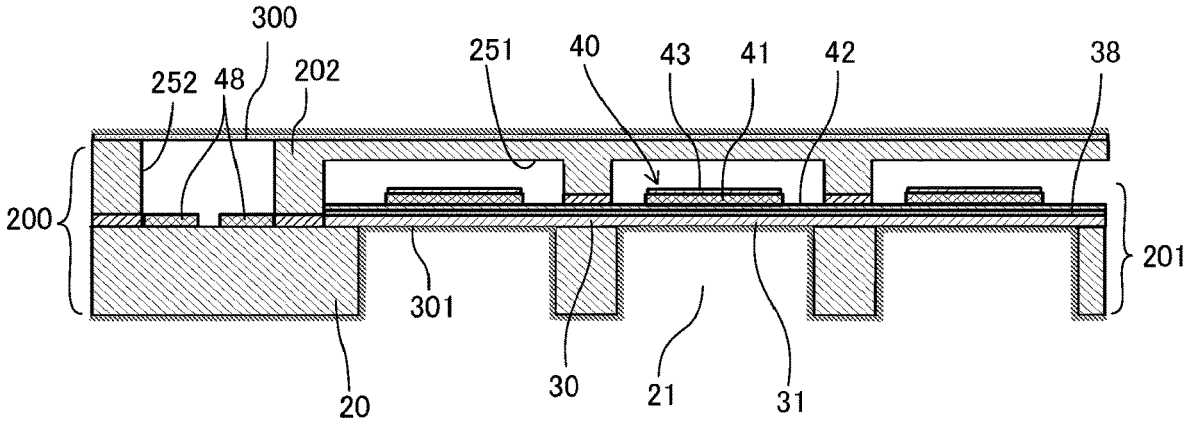
FIG. 4 is a schematic cross-sectional view of the bonded substrate illustrating a film formation of a protective firm on the bonded substrate.

FIG. 4 is a schematic cross-sectional view of the bonded substrate 200.

Figure 5:
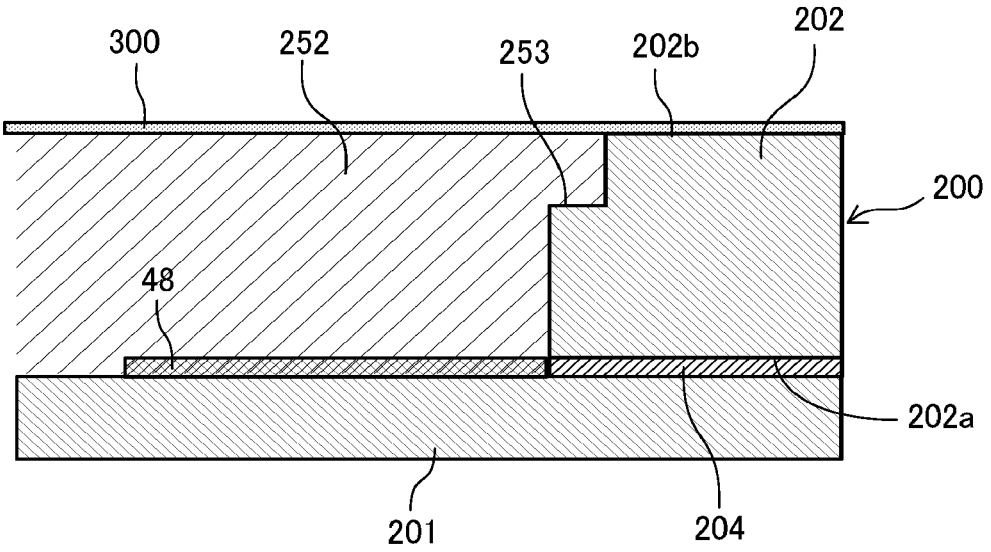
FIG. 5 is a schematic cross-sectional view of a main portion of the bonded substrate as similarly to FIG. 3.

FIG. 5 is a schematic cross-sectional view of a main portion of the bonded substrate 200 as similarly to FIG. 3.

A protective tape 300 is detachably attachable to the second surface 202*b* of the second substrate 202 of the bonded substrate 200. The wiring electrode 48 is exposed in the opening 252 of the second substrate 202. The opening 252 is illustrated with a wide diagonal hatching in FIG. 5.

Thus, a protective film 301 (see FIG. 4) may adhere to the wiring electrode 48 if the protective film 301 is film formed on the bonded substrate 200 without attaching the protective tape 300 to the second surface 202*b* of the second substrate. If the protective film 301 adheres to the wiring electrode 48, a connection failure occurs when the wiring electrode 48 is connected to an external wiring.

After the protective tape 300 is attached to the second surface 202*b* of the second substrate 202, a protective film 301 having a size of about 10 nm to 200 nm is uniformly formed in the pressure chamber 21 by an atomic layer deposition (ALD) method. The ALD method is a method of film forming a vapor-phase material called a precursor by repeating material injection and purging of unnecessary materials. The ALD method can form a film having a remarkably high uniformity while a film forming rate is low.

Here, as illustrated in FIG. 5, if the first substrate 201 and the second substrate 202 are completely sealed by the adhesive 204, the opening 252 becomes a closed space by the protective tape 300. Therefore, the gas phase material forming the protective film 301 does not enter the opening 252 when the protective film 301 is film formed. Thus, the protective film 301 does not adhere to a surface of the wiring electrode 48 or the like.

Next, an entrance of the protective film 301 into the opening 252 of the bonded substrate 200 is described below with reference to FIGS. 6 and 7.

Figure 6:
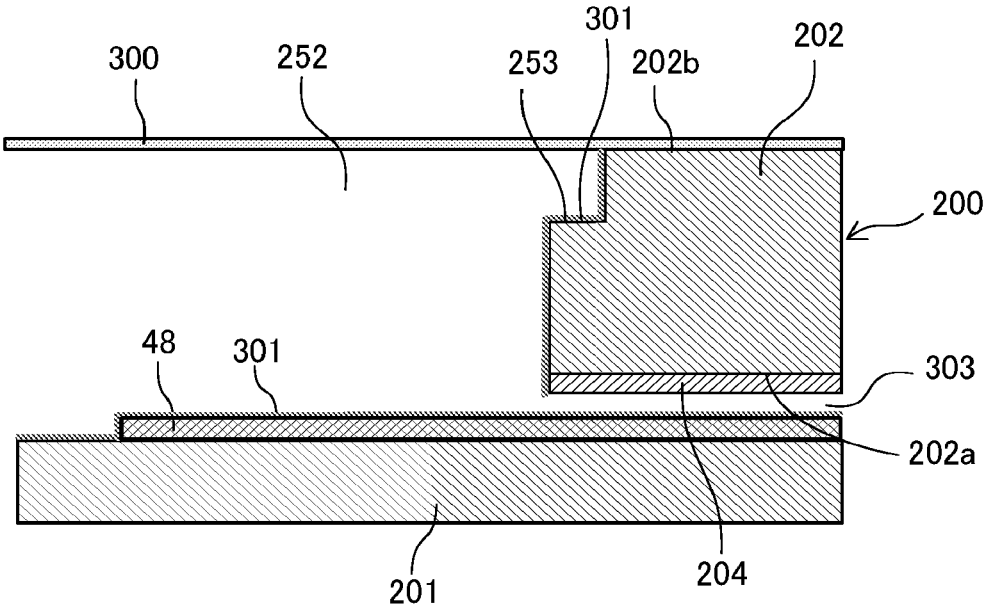
FIG. 6 is a schematic cross-sectional view of the bonded substrate illustrating an entrance of the protective film into the opening of the bonded substrate.

FIG. 6 is a schematic cross-sectional view of the bonded substrate 200.

Figure 7:
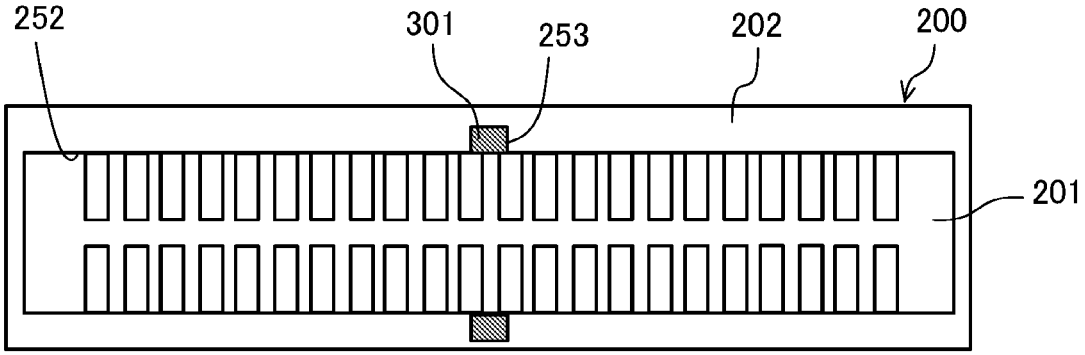
FIG. 7 is a schematic plan view of a main portion of the bonded substrate as similarly to FIG. 2.

FIG. 7 is a schematic plan view of a main portion of the bonded substrate 200 as similarly to FIG. 2.

As illustrated in FIG. 6, if the first substrate 201 and the second substrate 202 are not completely sealed by the adhesive 204 and a gap 303 is formed between the first substrate 201 and the second substrate 202, the opening 252 does not become a closed space even if the protective tape 300 is attached to the second surface 202*b* of the second substrate 202.

Therefore, the vapor-phase material that forms the protective film 301 enters inside the opening 252 when film forming the protective film 301. Thus, the protective film 301 may adhere to the surface of the wiring electrode 48 or the like.

Here, the wiring electrode 48 is made of $Al_2O_3$, and an adherence of the protective film 301 onto the surface of the wiring electrode 48 may not be visually recognized from an exterior of the head 1 since a color of the surface of the wiring electrode 48 and a color of the protective film 301 adhered on the wiring electrode 48 are almost the same color.

On the other hand, the second substrate 202 includes the third surface 253 having the reflectance higher than a reflectance of the surface of the wiring electrode 48. Since the third surface 253 is a surface of the second substrate 202, the third surface 253 is made of silicon.

As illustrated in FIGS. 6 and 7, if the vapor-phase material that forms the protective film 301 enters inside the opening 252, the vapor-phase material may adhere to the third surface 253 of the second substrate 202.

However, at the time of entrance of the vapor-phase material into the opening 252, a color of the third surface 253 changes by the adherence of the protective film 301 since the third surface 253 has the reflectance higher than the reflectance of the surface of the wiring electrode 48.

Thus, it is possible to visually recognize the adherence of the vapor-phase material that forms the protective film 301 or the protective film 301 onto the opening 252 in appearance since the third surface 253 has a high reflectance. Thus, the third surface 253 is also referred to as the "detection surface" to detect and determine the adherence of the protective film 301 onto the wiring electrode 48.

Thus, quality of the bonded substrate 200 can be easily determined. Therefore, the bonded substrate 200 according to the first embodiment can improve the reliability of the electrical connection of the head 1.

Next, a comparative example is described with reference to FIGS. 8 and 9.

Figure 8:
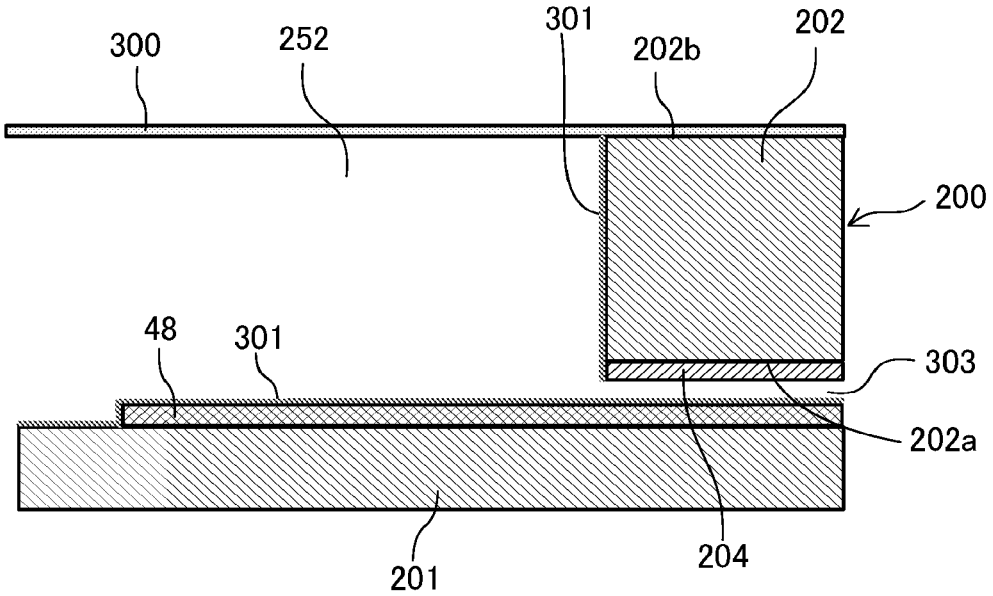
FIG. 8 is a schematic cross-sectional view of the bonded substrate according to a comparative example.

FIG. 8 is a schematic cross-sectional view of the bonded substrate 200 according to the comparative example.

Figure 9:
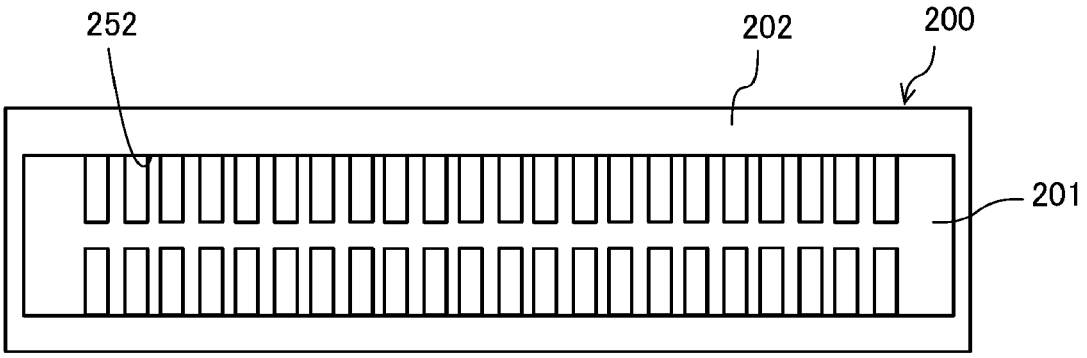
FIG. 9 is a schematic plan view of a main portion of the bonded substrate as similarly to FIG. 2.

FIG. 9 is a schematic plan view of a main portion of the bonded substrate 200 according to the comparative example as similarly to FIG. 2.

In the comparative example, the second substrate 202 does not include the third surface 253 according to the first embodiment adjacent to the opening 252 of the second substrate 202.

Even in this configuration according to the comparative example, if the first substrate 201 and the second substrate 202 are not completely sealed by the adhesive 204 and a gap 303 is formed between the first substrate 201 and the second substrate 202, the opening 252 does not become a closed space even if the protective tape 300 is attached to the second surface 202*b* of the second substrate 202 as illustrated in FIG. 8.

Therefore, the vapor-phase material that forms the protective film 301 enters inside the opening 252 when film forming the protective film 301. Thus, the protective film 301 may adhere to the surface of the wiring electrode 48 or the like.

Here, the wiring electrode 48 is made of $Al_2O_3$.

As illustrated in FIG. 9, the surface of the wiring electrode 48 on which the protective film 301 is adhered is visually substantially the same as the surface of the wiring electrode 48 on which the protective film 301 is not adhered. Thus, it is difficult to visually recognize the adherence of the protective film 301 onto the surface of the wiring electrode 48 from an exterior of the head 1.

Therefore, it may be difficult to determine the defect of the bonded substrate 200. Therefore, a defective bonded substrate 200 may be used as it is with defect as a component of the head 1. Thus, the defective bonded substrate 200 decreases reliability of the electrical connections between the wiring electrode 48 and the exterior of the head 1.

Next, the bonded substrate 200 according to a second embodiment of the present disclosure is described with reference to FIG. 10.

Figure 10:
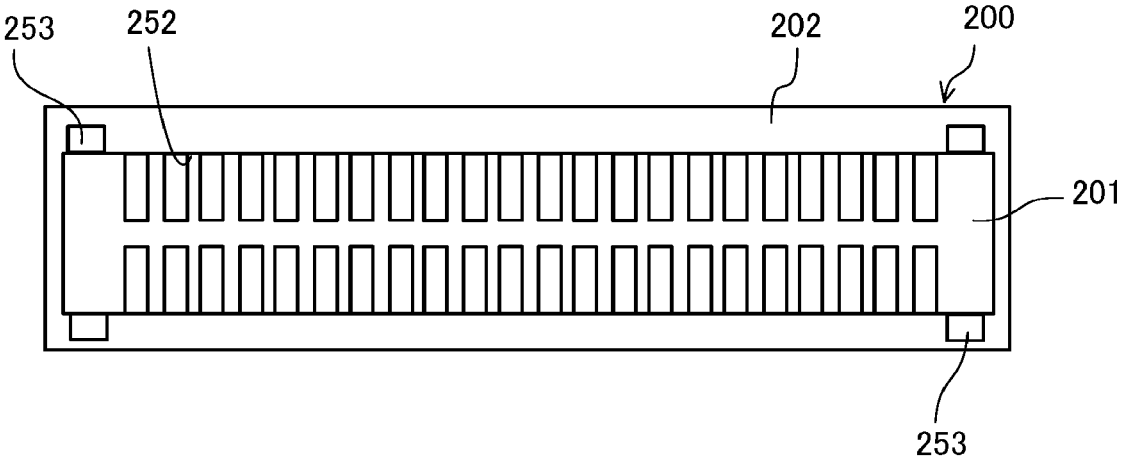
FIG. 10 is a schematic plan view of the bonded substrate according to a second embodiment of the present disclosure.

FIG. 10 is a schematic plan view of the bonded substrate 200 according to the second embodiment of the present disclosure.

The opening 252 in the second substrate 202 of the bonded substrate 200 has a rectangular shape in a plan view as illustrated in FIG. 10. That is, the opening 252 has a plurality of corners (four in FIG. 10). Further, the bonded substrate 200 in the second embodiment includes the third surface 253 at positions adjacent to each of four corners of the opening 252.

Thus, the third surface 253 (detection surface) includes a plurality of third surfaces 253 (detection surfaces) at positions adjacent to the plurality of corners of the opening 252, respectively.

Next, the head 1 according to a third embodiment of the present disclosure is described with reference to FIGS. 11 to 16.

Figure 11:
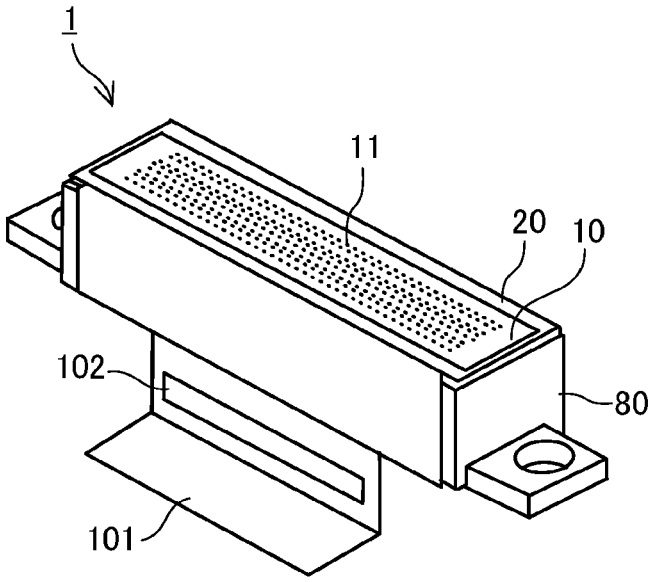
FIG. 11 is an outer perspective view of the liquid discharge head viewed from a nozzle surface side according to a third embodiment of the present disclosure.

FIG. 11 is an outer perspective view of the head 1 viewed from a nozzle surface side according to the third embodiment of the present disclosure.

Figure 12:
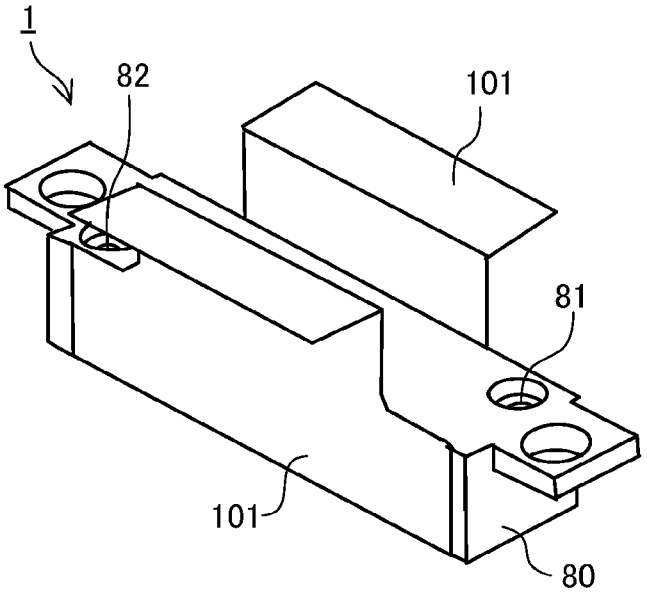
FIG. 12 is an outer perspective view of the liquid discharge head viewed from an opposite side of the nozzle surface side according to the second embodiment of the present disclosure.

FIG. 12 is an external perspective view of the head 1 viewed from a side opposite to the nozzle surface of the head 1 of FIG. 11.

Figure 13:
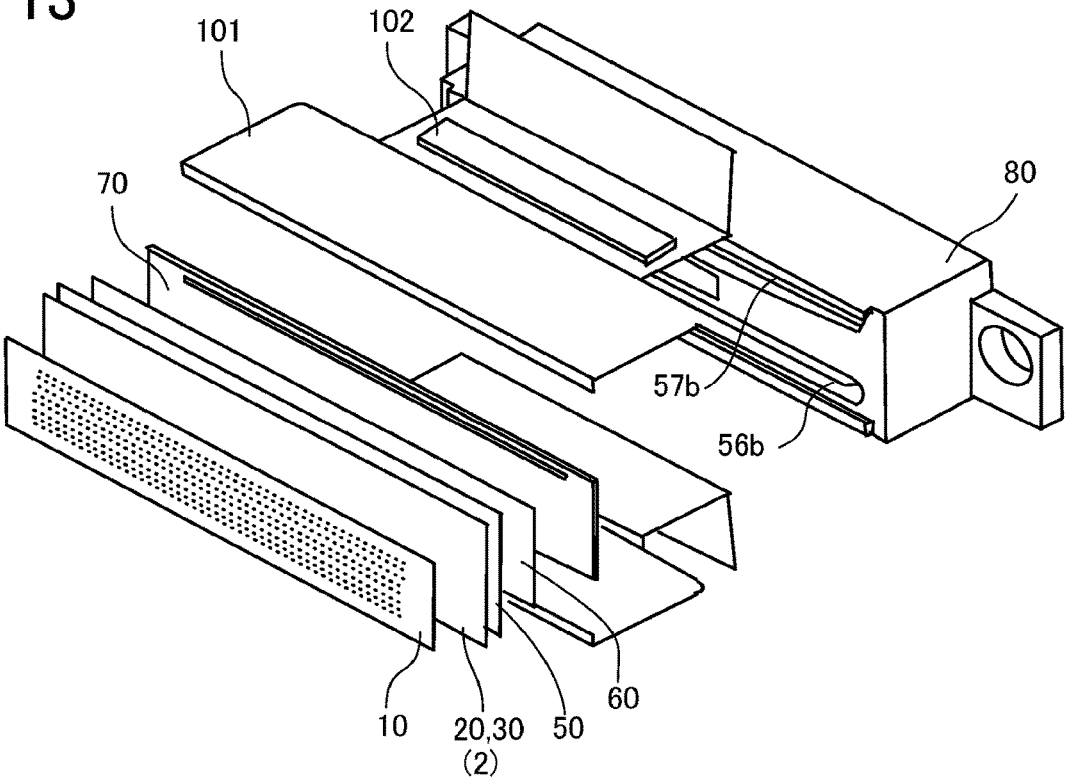
FIG. 13 is an exploded perspective view of the liquid discharge head according to the third embodiment of the present disclosure.

FIG. 13 is an exploded perspective view of the head 1.

Figure 14:
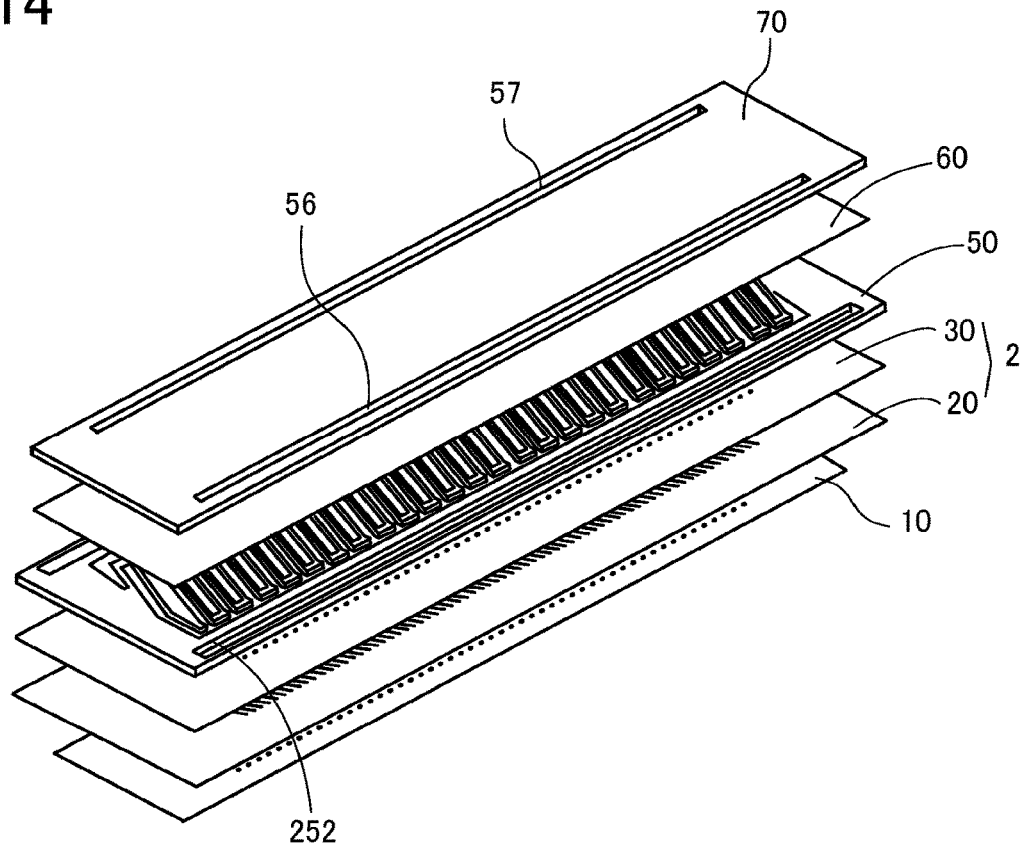
FIG. 14 is an exploded perspective view of a channel forming member of the liquid discharge head according to the third embodiment of the present disclosure.

FIG. 14 is an exploded perspective view of the channel plate 20 (channel forming member) of the head 1.

Figure 15:
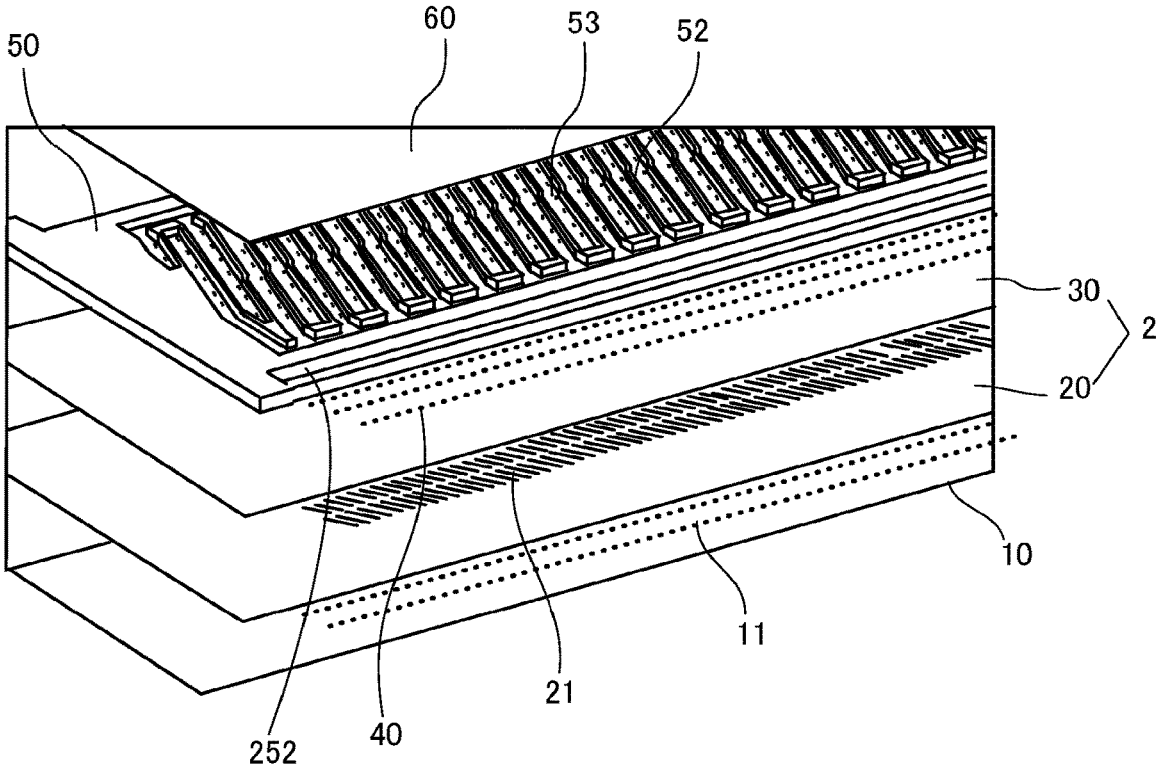
FIG. 15 is an enlarged perspective view of a main portion of the channel forming member of FIG. 14.

FIG. 15 is an enlarged perspective view of a main portion of the channel plate 20 (channel forming member) of FIG. 14.

Figure 16:
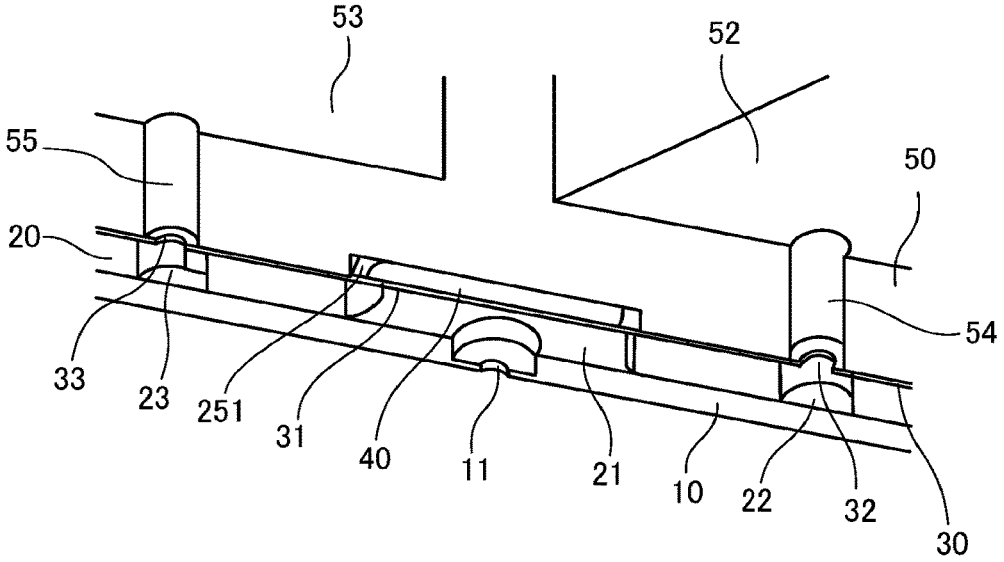
FIG. 16 is a cross-sectional perspective view of channels in the liquid discharge head according to the third embodiment of the present disclosure.

FIG. 16 is a cross-sectional perspective view of channels of the head 1.

The head 1 includes the nozzle plate 10, the channel plate 20 (individual channel member), the diaphragm 30, a common-branch channel member 50, a damper 60, a common-main channel member 70, a frame 80, and a flexible wiring 101 (wiring board) as the second substrate 202.

The head 1 includes a head driver 102 (driver IC) mounted on the flexible wiring 101 (wiring member). The head driver 102 is also referred to as a "driver integrated circuit (IC)." The head 1 in the second embodiment includes the actuator substrate 2 serving as the first substrate 201 formed by the channel plate 20 (individual channel member) and the diaphragm 30 as illustrated in FIGS. 13 to 15.

The nozzle plate 10 includes a plurality of nozzles 11 to discharge a liquid. The plurality of nozzles 11 are arrayed in a two-dimensional matrix.

The channel plate 20 (individual channel member) includes a plurality of pressure chambers 21 (individual chambers) respectively communicating with the plurality of nozzles 11, a plurality of individual supply channels 22 respectively communicating with the plurality of pressure chambers 21, and a plurality of individual collection channels 23 respectively communicating with the plurality of pressure chambers 21 (see FIG. 16).

A combination of one pressure chamber 21, one individual supply channel 22 communicating with one pressure chamber 21, and one individual collection channel 23 communicating with one pressure chamber 21 is collectively referred to as an individual chamber.

The diaphragm 30 forms the vibration region 31 serving as a deformable wall of the pressure chamber 21, and the piezoelectric element 40 is formed on the vibration region 31 so that the piezoelectric element 40 and the vibration region 31 form a single body (see FIG. 16). Further, the diaphragm 30 includes a supply opening 32 that communicates with the individual supply channel 22 and a collection opening 33 that communicates with the individual collection channel 23 (see FIG. 16). The piezoelectric element 40 is a pressure generator to deform the diaphragm 30 to apply pressure to the liquid in the pressure chamber 21.

Note that the channel plate 20 (individual channel member) and the diaphragm 30 are not limited to be separate members. For example, the channel plate 20 (individual channel member) and the diaphragm 30 may be formed by a single member using a silicon on insulator (SOI) substrate. That is, an SOI substrate in which a silicon oxide film, a silicon layer, and a silicon oxide film are film formed in this order on a silicon substrate can be used.

The silicon substrate in the SOI substrate may form the channel plate 20 (individual channel member). The silicon oxide film, the silicon layer, and the silicon oxide film in the SOI substrate may form the diaphragm 30. In such a configuration, the layer structure of the silicon oxide film, the silicon layer, and the silicon oxide film of the SOI substrate form the diaphragm 30. As described above, the diaphragm 30 includes a member made of the material that is film formed on a surface of the channel plate 20 (individual channel member).

The common-branch channel member 50 includes a plurality of common-supply branch channels 52 that communicate with two or more individual supply channels 22 and a plurality of common-collection branch channels 53 that communicate with two or more individual collection channels 23. The plurality of common-supply branch channels 52 and the plurality of common-collection branch channels 53 are arranged alternately adjacent to each other (see FIG. 15).

As illustrated in FIG. 16, the common-branch channel member 50 includes a through hole serving as a supply port 54 that connects the supply opening 32 of the individual supply channel 22 and the common-supply branch channel 52, and a through hole serving as a collection port 55 that connects the collection opening 33 of the individual collection channel 23 and the common-collection branch channel 53.

The common-branch channel member 50 includes a part 56*b* of one or more common-supply main channels 56 that communicate with the plurality of common-supply branch channels 52, and a part 57*b* of one or more common-collection main channels 57 that communicate with the plurality of common-collection branch channels 53 (see FIGS. 13 to 15).

The common-branch channel member 50 is the second substrate 202 as described above to be bonded to the actuator substrate 2 serving as the first substrate 201. The common-branch channel member 50 (second substrate 202) includes the accommodation part 251 to accommodate the piezoelectric element 40 of the actuator substrate 2 and the opening 252. The opening 252 exposes a wiring electrode such as the wiring electrode 48 of the above-described embodiment. The wiring electrode 48 connects the piezoelectric element 40 of the actuator substrate 2 and the exterior of the head 1.

As illustrated in FIG. 16, the damper 60 includes a supply-side damper that faces (opposes) the supply port 54 of the common-supply branch channel 52 and a collection-side damper that faces (opposes) the collection port 55 of the common-collection branch channel 53.

As illustrated in FIG. 15, the damper 60 seals grooves alternately arrayed in the same common-branch channel member 50 to form the common-supply branch channel 52 and the common-collection branch channel 53. The damper 60 forms a deformable wall of the common-supply branch channel 52 and the common-collection branch channel 53.

The common-main channel member 70 forms a common-supply main channel 56 that communicates with the plurality of common-supply branch channels 52 and a common-collection main channel 57 that communicate with the plurality of common-collection branch channels 53 (see FIG. 14).

The frame 80 includes the part 56*b* of the common-supply main channel 56 and the part 57*b* of the common-collection main channel 57 (see FIG. 13). The part 56*b* of the common-supply main channel 56 communicates with the supply port 81 (see FIG. 12) in the frame 80. The part 57*b* of the common-collection main channel 57 communicates with a collection port 82 (see FIG. 12) in the frame 80.

The bonded substrate 200 thus configured can prevent film formation of the protective film 301 on the wiring electrode 48 electrically connected to the piezoelectric element 40 (pressure generator) as similar to the first embodiment as described above. Thus, quality of the bonded substrate 200 can be easily determined.

Next, an example of a printer 500 serving as a liquid discharge apparatus according to a fourth embodiment is described with reference to FIGS. 17 and 18.

Figure 17:
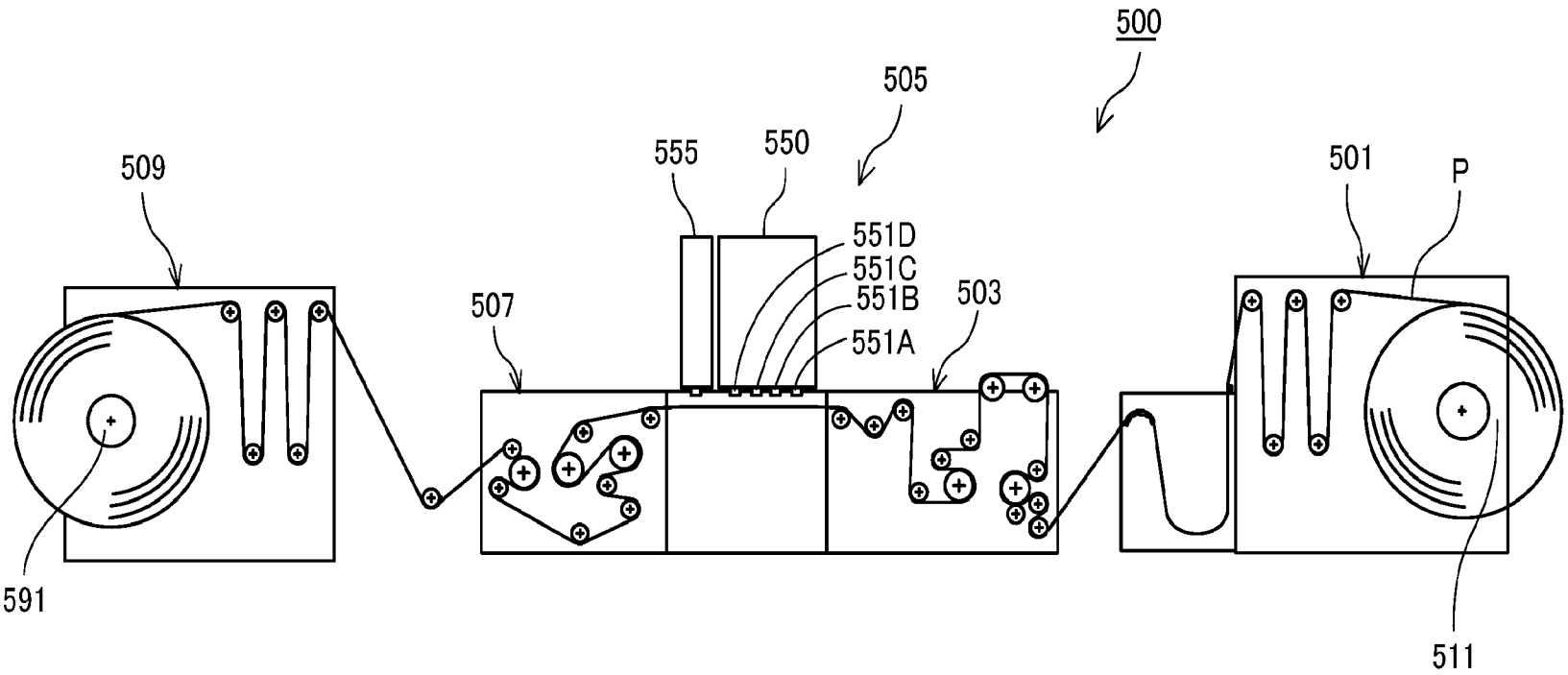
FIG. 17 is a schematic side view of a liquid discharge apparatus according to a fourth embodiment of the present disclosure.

FIG. 17 is a side view of the printer 500 according to the fourth embodiment of the present disclosure.

Figure 18:
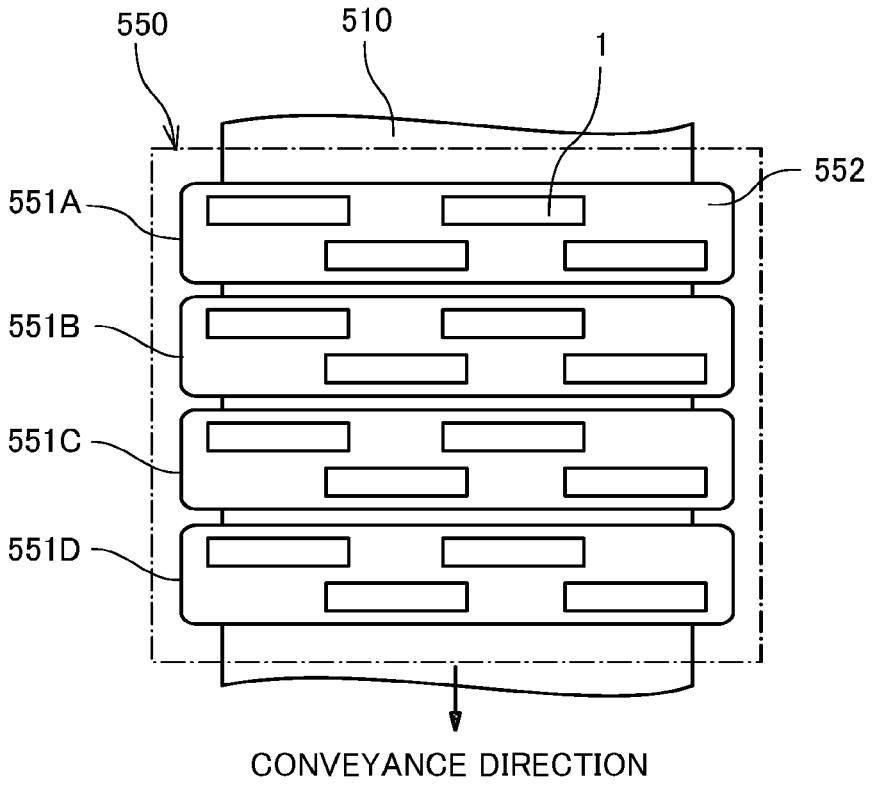
FIG. 18 is a plan view of an example of a head unit of the liquid discharge apparatus illustrated in FIG. 17.

FIG. 18 is a plan view of an example of a discharge unit of the printer according to the fourth embodiment of the present disclosure.

The printer 500 is the liquid discharge apparatus including the head 1 to discharge a liquid on a medium to form an image on the medium. The printer 500 includes a loading device 501, a guide conveyor 503, a printing device 505, a drying device 507, and an ejection device 509. The loading device 501 loads a web-like sheet P as the medium. The guide conveyor 503 guides and conveys the sheet P loaded by the loading device 501 to the printing device 505. The printing device 505 discharge a liquid onto the sheet P to form an image on the sheet P as a printing process. The drying device 507 dries the sheet P on which an image is formed by the printing device 505. The ejection device 509 ejects the sheet P conveyed from the drying device 507.

The sheet P is fed from a winding roller 511 of the loading device 501, guided and conveyed with rollers of the loading device 501, the guide conveyor 503, the drying device 507, and the ejection device 509, and wound around a take-up roller 591 of the ejection device 509.

In the printing device 505, the sheet P is conveyed so as to face a discharge device 550 and a discharge device 555. The discharge device 550 discharges the liquid onto the sheet P to form an image on the sheet P. The discharge device 555 discharges a treatment liquid onto the sheet P, on which an image is formed by the discharge device 550, to perform a post-treatment process.

The discharge device 550 includes, for example, four-color full-line head arrays 551A, 551B, 551C, and 551D from an upstream side in the direction of conveyance of the medium 510 indicated by arrow "conveyance direction" in FIG. 18. The head arrays 551A, 551B, 551C, and 551D are collectively referred to as "head arrays 551" unless colors are distinguished.

Each of the head arrays 551 is a liquid discharge device to discharge liquid of black (K), cyan (C), magenta (M), and yellow (Y) onto the sheet P conveyed in the conveyance direction of the sheet P as a continuous medium such as a web. Note that number and types of color are not limited to the above-described four colors of K, C, M, and Y and may be any other suitable number and types.

In the head array 551, for example, the heads 1 according to above-described embodiments of the present disclosure are arranged in a staggered manner on a base 552. Note that embodiments of the present disclosure are not limited to the arrangement and may be any other suitable head arrangement.

In the above-described embodiments, the bonded substrate 200 is a member to form the head 1. However, the bonded substrate 200 is not limited to form the head 1.

The bonded substrate 200 includes the first substrate 201 and the second substrate 202. The first substrate 201 includes the wiring electrode 48. The second substrate 202 includes the opening 252 to expose the wiring electrode 48. The second substrate 202 includes a third surface 253 adjacent to the opening 252. The third surface 253 of the second substrate 202 has a higher reflectance than the surface of the wiring electrode 48.

Examples of such bonded substrates 200 include semiconductor substrates.

Thus, the bonded substrate 200 improves reliability of the electrical connections between the wiring electrode 48 and the exterior of the head 1.

In the present embodiment, discharged liquid is not limited to a particular liquid as long as the liquid has a viscosity or surface tension to be discharged from a head (liquid discharge head).

However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or mechanism combined to the head to form a single unit.

For example, the "liquid discharge device" includes a combination of the head with at least one of a head tank, a carriage, a supply unit, a maintenance unit, a main scan moving unit, and a liquid circulation apparatus.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another. The head may be detachably attached to the functional part(s) or unit(s) s each other.

For example, the head and the head tank may form the liquid discharge device as a single unit. Alternatively, the head and the head tank coupled (connected) with a tube or the like may form the liquid discharge device as a single unit. Here, a unit including a filter may further be added to a portion between the head tank and the head of the liquid discharge device.

Examples of the liquid discharge device further include the head coupled (connected) with a carriage to form a single unit.

The liquid discharge device may include the head movably held by a guide that forms part of a main scan moving unit, so that the head and the main scan moving unit form a single unit. The liquid discharge device may include the head, the carriage, and the main scan moving unit that form a single unit.

Examples of the liquid discharge device further include the head, the carriage, and the maintenance mechanism to form a single unit, in such a manner that the head is mounted on the carriage and a cap of the maintenance mechanism is secured to the carriage.

Further, the liquid discharge device may include a tube connected to the head mounting the head tank or the channel member so that the head and a supply unit form a single unit. Liquid is supplied from a liquid reservoir source to the head via the tube.

The main scan moving unit may be a guide only. The supply unit may be a tube(s) only or a loading unit only.

The "liquid discharge device" includes a head module including the above-described head, and a head device in which the above-described functional components and mechanisms are combined to form a single unit.

The term "liquid discharge apparatus" used herein also represents an apparatus including the head, the discharge device, the head module, and the head device to discharge liquid by driving the head.

The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere.

The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The liquid discharge apparatus is not limited to an apparatus to discharge liquid to visualize meaningful images, such as letters or figures.

For example, the liquid discharge apparatus may be an apparatus to form arbitrary images, such as arbitrary patterns, or fabricate three-dimensional images.

The above-described term "material onto which liquid can adhere" represents a material onto which liquid at least temporarily adheres, a material onto which liquid adheres and fixes, or a material onto which liquid adheres to permeate.

Examples of the "material onto which liquid can adhere" include recording media such as a paper sheet, recording paper, and a recording sheet of paper, film, and cloth, electronic components such as an electronic substrate and a piezoelectric element, and media such as a powder layer, an organ model, and a testing cell.

The "material onto which liquid can adhere" includes any material on which liquid adheres unless particularly limited.

Examples of the "material onto which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material onto which liquid can adhere.

However, the liquid discharge apparatus is not limited to such an apparatus.

For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation," "recording," "printing," "image printing," and "fabricating" used in the present embodiments may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head configured to discharge a liquid, the liquid discharge head comprising:

an actuator substrate; and a holding substrate bonded to the actuator substrate, wherein the actuator substrate comprises:

a pressure generator; and a wiring electrode configured to electrically connect the pressure generator and an exterior of the liquid discharge head, and the holding substrate comprises:

an opening configured to expose the wiring electrode to the exterior of the liquid discharge head; and a detection surface adjacent to the opening, the detection surface having a higher reflectance than a surface of the wiring electrode of the actuator substrate.

2. The liquid discharge head according to claim 1, wherein the detection surface is adjacent to an inner wall surface of the opening.

3. The liquid discharge head according to claim 1, wherein the opening has a plurality of corners in a plan view of the liquid discharge head, and the detection surface includes a plurality of detection surfaces at positions adjacent to the plurality of corners of the opening, respectively.

4. The liquid discharge head according to claim 1, wherein the opening has a rectangular shape in a plan view of the liquid discharge head; and the detection surface is at a position adjacent to a center of the opening in a longitudinal direction of the holding substrate.

5. The liquid discharge head according to claim 1, wherein the detection surface is made of same material as the holding substrate.

6. The liquid discharge head according to claim 5, wherein the detection surface is made of silicon, and the wiring electrode is made of metal.

7. The liquid discharge head according to claim 1, wherein the holding substrate includes:

a first surface bonded to the actuator substrate; and a second surface opposite to the first surface, and the detection surface is higher than the first surface and lower than the second surface.

8. The liquid discharge head according to claim 7, wherein a protective tape is detachably attachable to the second surface of the holding substrate.

9. A discharge device comprising:

the liquid discharge head according to claim 1.

10. A liquid discharge apparatus comprising:

the discharge device according to claim 9.

11. A bonded substrate comprising:

a first substrate including a wiring electrode; and a second substrate bonded to the first substrate, the second substrate including:

an opening configured to expose the wiring electrode to an exterior of the bonded substrate; and a detection surface adjacent to the opening, the detection surface having a higher reflectance than a surface of the wiring electrode of the first substrate.

* * * * *